US005477908A

United States Patent [19]

Landua

[11] Patent Number: 5,477,908

[45] Date of Patent: Dec. 26, 1995

[54] APPARATUS FOR DEBURRING MOULDS AND CORES

[75] Inventor: Werner Landua, Mannheim, Germany

[73] Assignee: Adolf Hottinger Maschinenbau GmbH, Mannheim, Germany

[21] Appl. No.: 187,076

[22] Filed: Jan. 27, 1994

[30] Foreign Application Priority Data

Jan. 27, 1993 [DE] Germany ..... 43 02 227.8

[51] Int. Cl.[6] ..... B22D 31/00

[52] U.S. Cl. ..... 164/262; 164/70.1; 83/180

[58] Field of Search ..... 164/262, 70.1, 164/460, 263; 83/214, 180

[56] References Cited

U.S. PATENT DOCUMENTS

| | | | |
|---|---|---|---|
| 3,795,175 | 3/1974 | Numao et al. | 83/914 |
| 4,362,448 | 12/1982 | Hasebe et al. | 164/263 |
| 5,343,929 | 9/1994 | Landua et al. | 164/262 |

FOREIGN PATENT DOCUMENTS

| | | |
|---|---|---|
| 3617575 | 6/1985 | Germany . |
| 58-187257 | 11/1983 | Japan . |
| 59-21523 | 12/1984 | Japan . |
| 61-78536 | 4/1986 | Japan . |
| 63-303678 | 12/1988 | Japan . |
| 2220765 | 9/1990 | Japan . |

*Primary Examiner*—P. Austin Bradley
*Assistant Examiner*—Randolph S. Herrick
*Attorney, Agent, or Firm*—Antonelli, Terry, Stout & Kraus

[57] ABSTRACT

An apparatus for removing burrs in confined spaces of molds or cores is disclosed. The apparatus includes a retaining body; and at least one deburring element resiliently mounted in an unloaded state on an outer circumference of the retaining body. The at least one deburring element has a ring containing a separating point. The separating point is inclined to a longitudinal axis of the retaining body at an angle of 45°. Alternatively, in accordance with the invention, at least one deburring element is resiliently mounted in an unloaded state on an outer circumference of the retaining body. Each deburring element has a deburring portion projecting radially outward from a remainder of the deburring element for removing the burrs and is retained in the outer circumference to be axially displaceable with the retaining body in a first axial direction and in a second axial direction opposite to the first axial direction. Each deburring element is displaceable radially inward during motion of the retaining body in the first axial direction and displaced radially outward during axial motion of the retaining body in the second axial direction.

13 Claims, 5 Drawing Sheets

APPARATUS FOR DEBURRING MOULDS AND CORES

TECHNICAL FIELD

The invention relates to an apparatus for deburring moulds or cores, particularly in confined clearances or gaps of such moulds which are generally sand moulds or cores, such as water jacket cores, bed cores or combinations thereof, and which are provided for the casting of metallic parts, such as e.g. engine blocks and the like.

BACKGROUND ART

In the case of many of the the moulds, e.g. when combining water jacket and bed moulds, between individual portions or mould shapes there are very narrow gaps or clearances in which, following the production of the sand moulds or cores, burrs can be left behind, e.g. in the vicinity of the parting line between a lower tool and an upper tool in which the corresponding moulds or cores are produced. For automation reasons jointly produced water jacket and bed cores must be immediately assembled. It is then difficult to have access to the gaps in order to remove the burrs, particularly if this is also to take place in a completely automatic manner.

DISCLOSURE OF THE INVENTION

The invention is an apparatus permitting automatic deburring in narrow, deep gaps of core or mould parts.

The invention solves this problem by a holding or retaining body, on whose circumference is radially resiliently mounted at least one deburring element which projects radially over the retaining or holding body in the unloaded state.

According to a preferred embodiment of the invention, the deburring element is a ring provided with a separating point and the latter is in particular inclined to the axis, preferably by 45°.

A construction for deburring more complete parts provides for the use of deburring tools as deburring elements which are axially displaceably mounted in such a way that they fall back on displacement in one direction and move forwards during displacement in the opposite direction. The deburring tools have a deburring portion which extends away from the retaining body with an angle relative to the displacement direction.

The retaining body can have a variety of shapes. In the preferred embodiment it is cylinder jacket-shaped, i.e. has the cross-section of a cylindrical section. It can also have a rectangular or polygonal cross-section or a cross-section with an irregular curve. However, as a rule the cross-section remains substantially identical over the entire height of the retaining body. Thus, the retaining body with its deburring bodies is preferably located in its lower area and is at least radially movable, but optionally also axially movable, and can be inserted with deburring portions oriented perpendicular to the displacement direction in the gaps of the workpiece to be worked until the deburring portions of the deburring tools are engaged below the burrs. As a result of the reciprocating movement, the free sides of the deburring portions slowly scratch away the burrs so that the latter are removed. While the deburring portions can project outwards perpendicular to the axis of the retaining body e.g. project radially outwards in the case of a cylinder jacket-shaped retaining body, the apparatus according to the invention can also be constructed in such a way that the deburring portions project inwardly, i.e. in opposition to one another, e.g. radially inwardly in the case of a cylinder jacket-shaped retaining body. The radial extension of the deburring portions need not be the same over the entire circumference of the retaining body and can instead differ, e.g. can be shortened or flattened in particularly narrow areas.

According to another preferred embodiment of the apparatus according to the invention,the deburring tools are movably mounted with clearance in the displacement direction and perpendicular thereto in a gap between the retaining body and a retaining ring surrounding the latter.

According to a further embodiment of the invention, the deburring tools are constructed as an angular part with a guide leg extending in the displacement direction, which ensures a reliable guidance of the deburring tools.

According to a further embodiment of the invention the deburring tools are mounted on a sloping surface and in particular the entire arrangement has a substantially circular cross-section.

According to another embodiment of the invention the deburring portions of the deburring elements in different circumferential areas extend in varying radial widths or over different lengths, i.e. optionally the deburring portions of the individual deburring laminas extend over varying widths perpendicular to the displacement direction or have different lengths.

According to a further embodiment of the invention several retaining bodies are provided with at least radially flexibly mounted deburring tools thereon and in particular several retaining bodies with axially displaceable and inwardly and outwardly movable deburring tools with deburring portions extending perpendicular to the displacement direction are placed on a mounting plate. If multipart workpieces are to be worked and which are assembled together, a further advantageous development of the invention is that, besides the retaining bodies, there are elastically pretensioned spring bolts extending parallel to the displacement direction.

BRIEF DESCRIPTION OF THE DRAWINGS

The invention is described in greater detail hereinafter relative to a non-limitative embodiments and with reference to the attached drawings, wherein show.

BEST MODE FOR CARRYING OUT THE INVENTION

Figure 1:
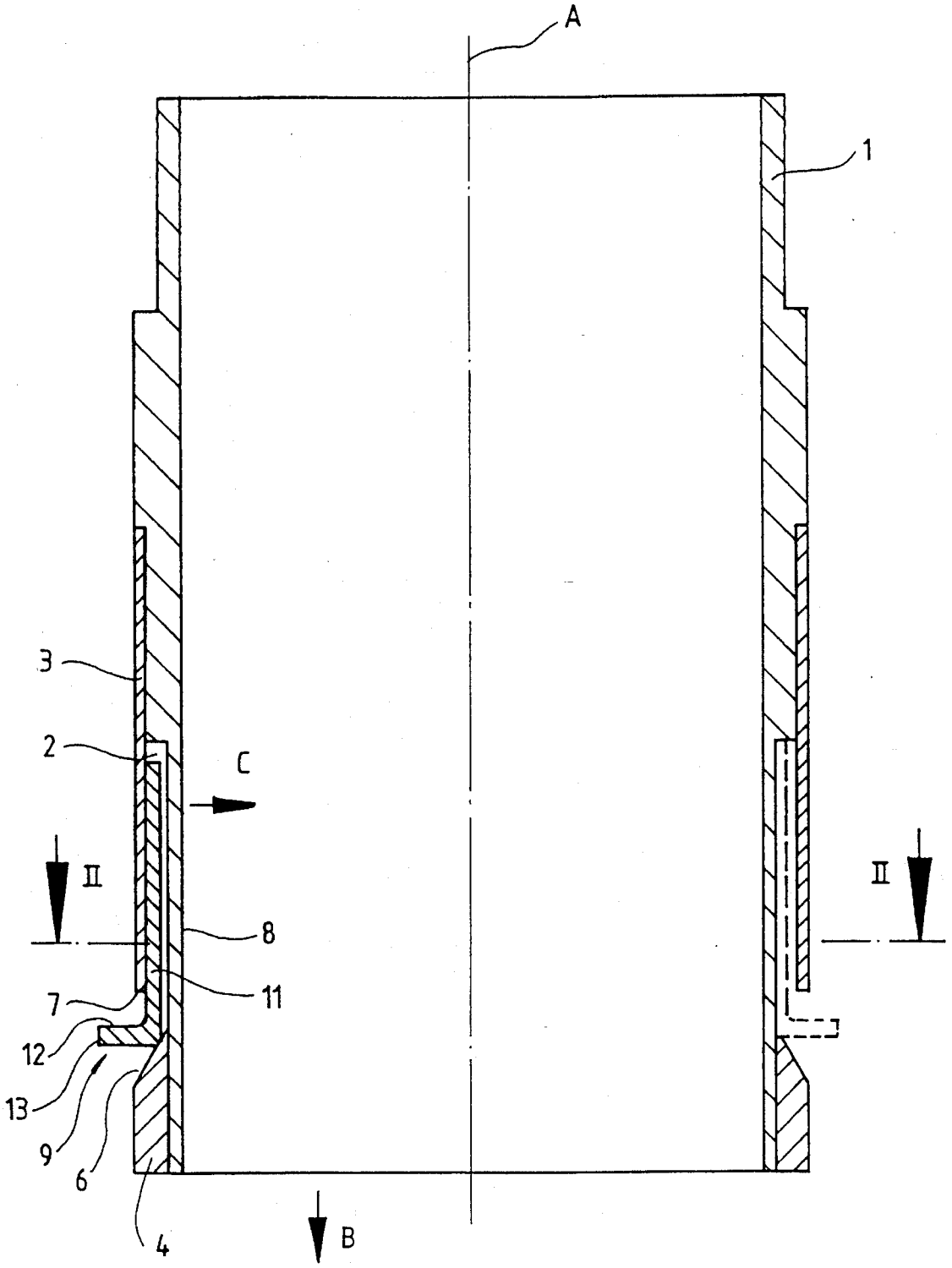
FIG. 1 is a longitudinal section through the preferred embodiment of the deburring apparatus according to the invention.

The apparatus according to the invention for deburring moulds or cores has a holding or retaining body 1, which in the represented, preferred embodiment is fundamentally shaped like a cylinder jacket. However, the retaining body 1 can have a variety of contours, to include a rectangular or polygonal contour or an irregularly curved cross-sectional shape. All that is important is that the cross-sectional shape is substantially identical over its entire height.

On the outside of the retaining body 1 in the lower area thereof is formed an annular recess 2, which is covered from the top to the outside, i.e. over its entire circumference by a holding or retaining ring 3. Directly on the retaining body 1, below the retaining ring 3, there is an expanding ring 4. The upper area 6 of the expanding ring 4 is bevelled, e.g. under an angle of 30° to the longitudinal axis A of the retaining body 1 and has a finite spacing from the lower edge 7 of the retaining ring 3.

A plurality of deburring tools 9 are arranged around the circumference of the retaining body 1 in the annular recess 2 between the retaining ring 3 and the area 8 of the body 1 located at this level. In the represented embodiment the tools are constructed as angular parts and have a guide leg 11, which is oriented parallel to the axis A and projects into the recess 2. At the lower end of the guide leg 11 is constructed in angular manner a deburring portion 12, which projects outwards, in this case radially outwards in the gap between the lower edge 7 of the retaining ring 3 and the bevel 6 of the expanding ring 4. The width of the guide leg 11 is smaller than the width of the recess 2 between the retaining ring 3 and the area 8 of the retaining body 1. If the deburring tool 9 with the free end 13 of the deburring portion 12 is forced upwards by a burr on a workpiece to be worked (on moving down the apparatus according to the invention with the retaining body 1 in the direction B), then the deburring tool slides along the bevel 6 on the one hand counter to the movement direction B of the retaining body 1 in the upwards direction, but on the other hand also moves perpendicular to the movement direction B in the direction C inwards, i.e. radially inwards. However, if the retaining body 1 is moved linearly upwards again counter to the movement direction B (the reciprocating movement e.g. extending over 10 mm), then the outer, upper edge of the deburring portion 12 comes to rest on a burr, is drawn outwards therefrom and simultaneously in opposition to the direction C (radially), until the deburring tool comes to rest with its guide leg 11 on the retaining ring 3. If the retaining body 1 is then moved further upwards, the outer upper edge of the deburring portion 12 of the deburring tool 9 strips off the burr of the mould or core to be worked.

Figure 2:
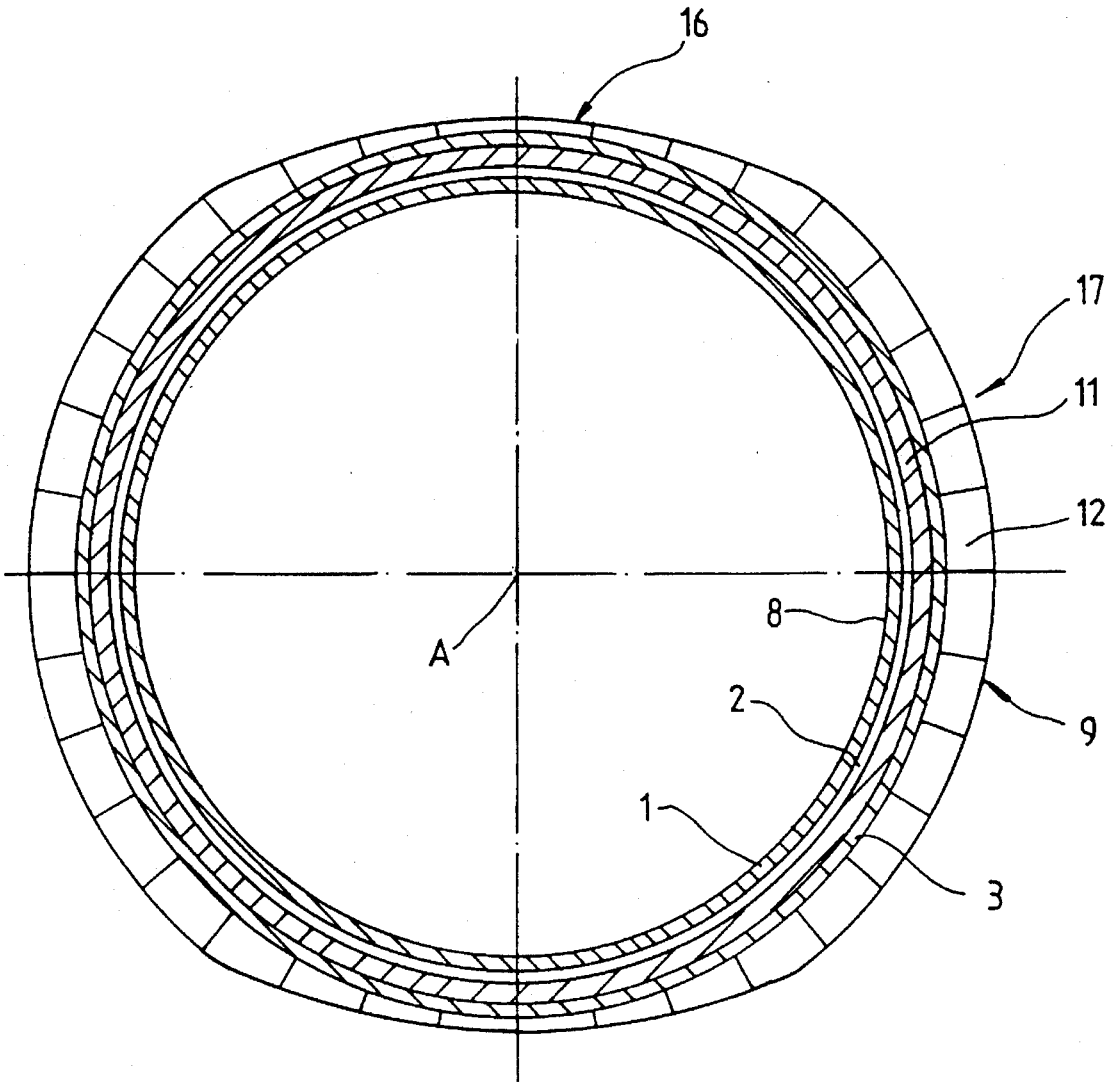
FIG. 2 is a cross-section corresponding to section line II—II of FIG. 1.

The extension of the deburring portion 12 can also be different, e.g. in the case of a retaining body 1 with a fundamentally cylindrical cross-section so as to adapt to the workpieces to be worked, such as moulds or cores and as shown in FIG. 2, where in very narrow areas between parts of such a workpiece, e.g. cylindrical parts of a bed core and between areas of a water jacket core projecting between them (FIG. 3) have to be deburred. For this purpose the deburring portions in the area 16 of FIG. 2 are shortened compared with those in the area 17.

Figure 3:
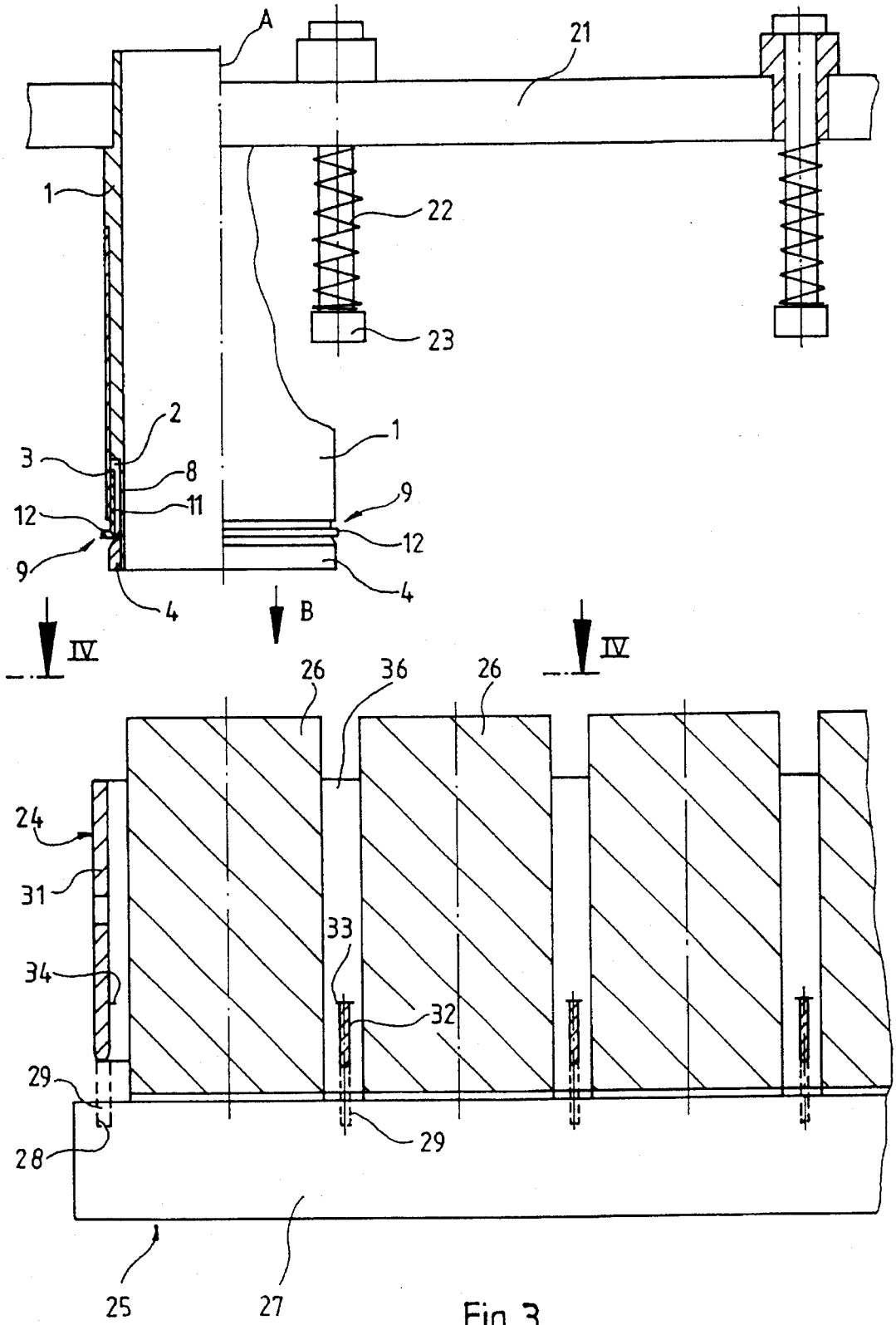
FIG. 3 is a representation of the use of an apparatus according to the invention.

Whereas in FIG. 1 is shown a deburring apparatus according to the invention, which solely comprises a retaining body 1 on which can act a device for the reciprocation thereof in the direction B parallel to the axis A, FIG. 3 shows such an apparatus for the water jacket and bed core of an internal combustion engine. In the case of the apparatus according to the invention shown in FIG. 3 on a mounting plate 21 there are several retaining bodies 1 fixed in accordance with the arrangement described relative to FIG. 1, but whereof only one is shown partly in longitudinal section (left-hand side) and partly in outside view with broken away portions.

On the mounting plate 21 there are also spring bolts 23, elastically pretensioned by a spring 22, which extend in the direction of the axis A and therefore in the movement direction B of the apparatus. The spring bolts 23 come to rest in an area **23*a* of the water jacket core 24 and prevent the detachment thereof from the bed core 25**.

Using the apparatus according to the invention shown in the top part of FIG. 3 working takes place of a water jacket-bed core combination shown in the lower part of FIG. 3. Such a workpiece comprises the water jacket core 24 and the bed core 25, surrounding one piece cylinder parts 26. The water jacket core 24 is attached to a lower part 27 of the bed core 25 and is held in the latter in an immovable manner by pins 29 projecting into recesses 28.

Whereas the circumferential wall 31 of the water jacket core extends over virtually the entire height of the cylinder parts 26, between the latter are formed the ribs 32 of the water jacket core and which project by only a limited height over the plate 27. After the production of the water jacket, core burrs 33 are left behind in the upper area of the ribs 32. Correspondingly burrs 34 are left behind at the same height on the inside of the outer wall 31. Such burrs are removed by the apparatus according to the invention, the gap between the ribs 32 and the outer wall 31 and the cylinder parts 26 being only a few mm, e.g. 8 to 10 mm. The distance between the burrs 33,34 and the upper edge of the water jacket core 24 is several cm, e.g. approximately 10 cm.

For deburring purposes the apparatus according to the invention passes with its retaining bodies 1 into the gap 36 between the water jacket core 24 and the cylinder portions 26 of the bed core 25, the areas 16 of the deburring portions 12 of the deburring tools 9 projecting into the area 16a between the ribs 32 and the cylinder part 26 of the bed core 25, while the areas 17 of the deburring tools 9 project into an area **17*a*** displaced by 90° thereto or are oriented therein.

The apparatus according to the invention moves the retaining body 1 into the gap between the wall 3i and the cylinder parts 26 until the spring bolts 23 in the areas **23*a* (FIG. 4) engage on the water jacket core 24. When this engagement has taken place, the deburring portions 12 of the deburring tools 9 are still above the burrs 33,34. The mounting plate 21 and with it the retaining body 1 are then moved further downwards and then, as described hereinbefore, the deburring tools 9 are firstly raised by the burrs 33,34 and move radially inwards. If the free space left by the burrs 33,34 is sufficient, they either drop downwards past the burrs and move outwards again, or during further downward movements when they can not move further inwards, they cut off the outer area of the burrs 33,34. The apparatus according to the invention moves downwards and upwards. If it moves upwards again, it carries the deburring tools with it and their outer upper edge engages on the burrs 33,34 and cuts them off. The upward and downward movements are repeated until the burrs 33,34** have been completely removed.

Figure 5:
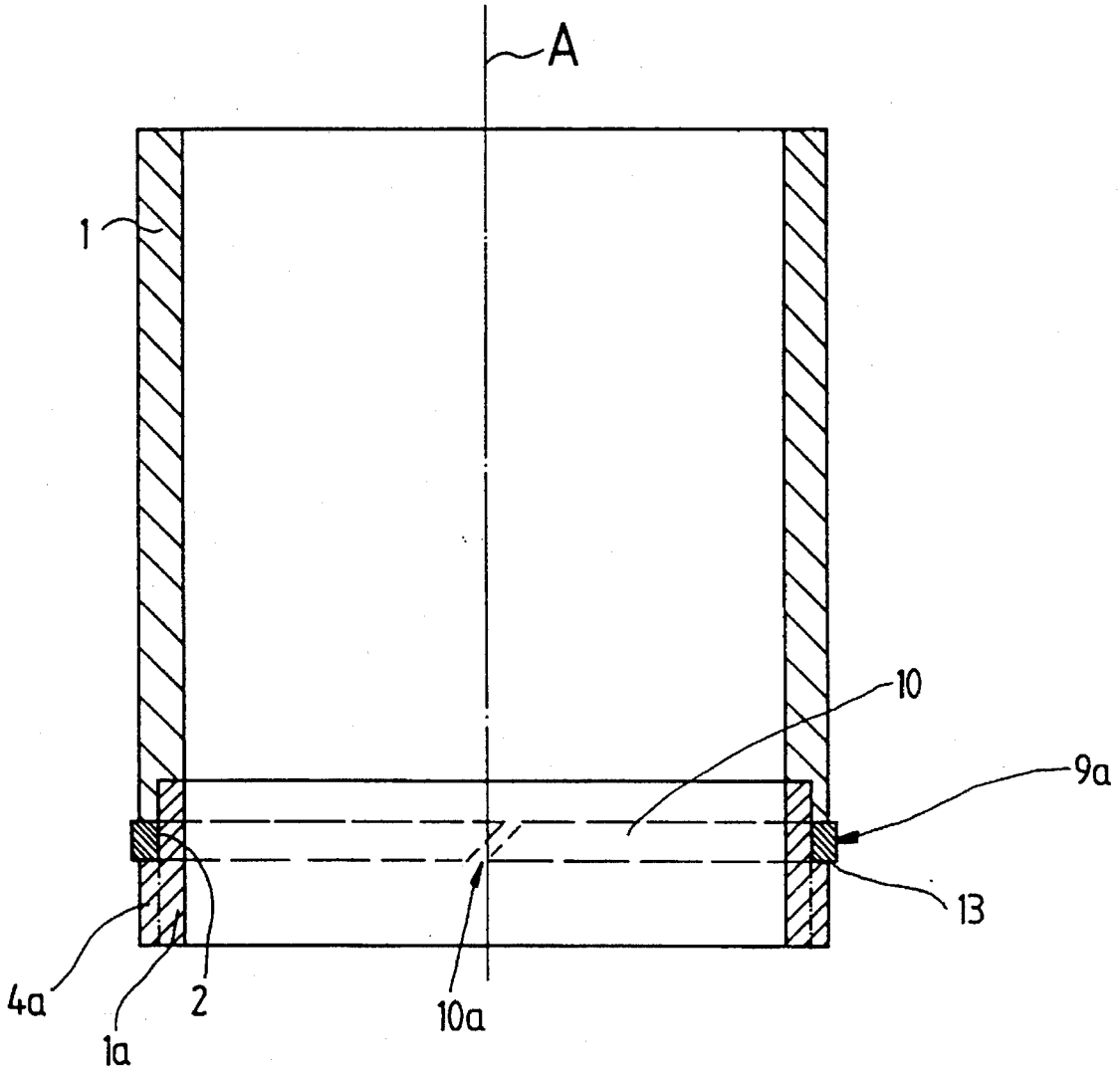
FIG. 5 is a further simplified embodiment of the invention.

FIG. 5 shows in longitudinal section a further embodiment of the apparatus according to the invention. Identical parts are given the same reference numerals as hereinbefore.

This apparatus once again has a retaining body 1 in the form of a cylinder jacket. To the latter is fixed in the lower area an inner ring **1*a*, such as by bonding, but it can optionally also be constructed in one piece with the retaining body 1. Over the inner ring 1*a* is engaged with radial clearance a deburring tool 9*a* in the form of a ring 10 provided with a separating point 10*a* and which is axially secured by a support ring 4*a* mounted firmly on the inner ring 1***a* or connected in one piece therewith.

For manufacturing reasons either the parts 1,1*a*,4*a* are all separate parts which are bonded to ether, or the inner ring 1*a* is either constructed in one piece with the retaining body 1 or with the support ring 4*a* and is firmly connected to the other part.

The radial clearance between the inner ring 1*a* and the deburring tool 9*a* is e.g. such that the external diameter of the inner ring 1*a* is 80 mm, while the internal diameter of the deburring tool 9*a* is 81 mm. The radial width of the slot or the separating point 10*a* is such that the deburring ring 9*a* can radially give way in the desired manner, i.e . can reduce its diameter. The separating point 10*a* is inclined to the retaining body axis A, preferably by 45°, so that the two ends of the ring overlap in this area and consequently a deburring at the deburring edge 13 takes place over the entire circumference.

Otherwise this apparatus c n have further features in the manner described hereinbefore, for example the ring need not be completely circular symmetrical, particularly in its outer area and can instead have different radial extension in different angular areas, as a function of the shape of the parts to be deburred.

Figure 4:
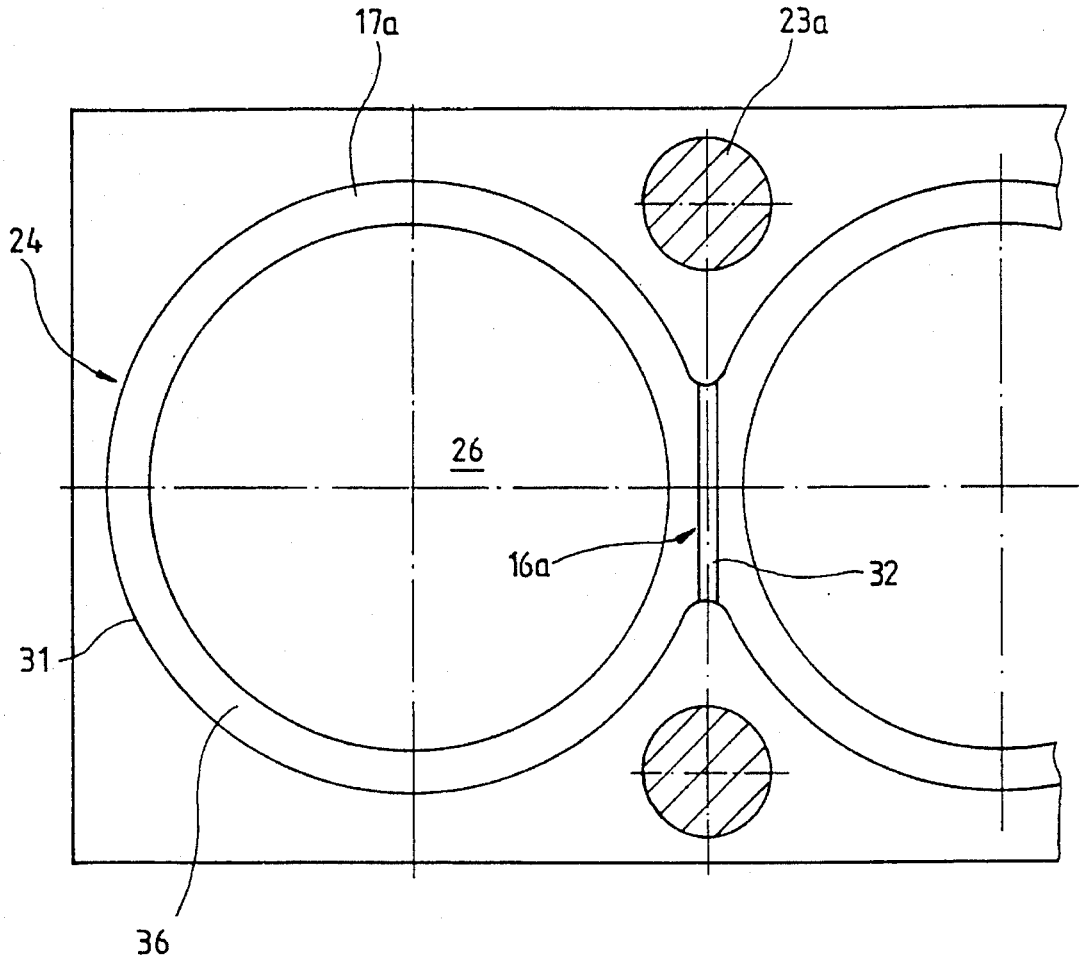
FIG. 4 is a view corresponding to section line IV—IV of FIG. 3.

The deburring apparatus according to FIG. 5 is fundamentally used in the manner described hereinbefore with reference to FIGS. 3 and 4. For cross-sectional reduction purposes there are no axial movements relative to the retaining body 1, as is the case with the tools according to FIGS. 1 and 2. Instead the deburring tool 9 reduces its diameter, which is made possible by the indicated clearance and the slot 10*a*.

I claim:

1. An apparatus for removing burrs in confined spaces of molds or cores comprising:

a retaining body; and at least one deburring element resiliently mounted in an unloaded state on an outer circumference of the retaining body, the at least one deburring element having a ring containing a separating point.

2. An apparatus in accordance with claim 1 wherein:

the separating point is inclined to a longitudinal axis of the retaining body at an angle of 45°.

3. An apparatus in accordance with claim 1 wherein:

the retaining body has a cross-sectional shape which is a cylindrical section.

4. An apparatus in accordance with claim 1 further comprising:

a plurality of retaining bodies, each retaining body having at least one of the deburring elements with each deburring element being movable at least radially inward during motion in the first axial direction.

5. An apparatus for removing burrs in confined spaces of molds or cores comprising:

a retaining body; and at least one deburring element resiliently mounted in an unloaded state on an outer circumference of the retaining body, each deburring element having a deburring portion projecting radially outward from a portion of the deburring element for removing the burrs and being retained in the outer circumference to be axially displaceable with the retaining body in a first axial direction and in a second axial direction opposite to the first axial direction, each deburring element is displaceable radially inward during motion of the retaining body in the first axial direction and displaced radially outward during axial motion of the retaining body in the second axial direction.

6. An apparatus in accordance with claim 5 further comprising:

a retaining ring attached to a portion of the outer circumference of the retaining body and forming a circumferential gap with another portion of the outer circumference of the retaining body, the deburring element being movably mounted in the circumferential gap with clearance and being movable radially inward in the circumferential gap during motion of the retaining body in the first axial direction.

7. An apparatus in accordance with claim 5 wherein:

each deburring element has a guide leg extending along a longitudinal axis of the retaining body with the deburring portion projecting radially outward from the guide leg for removing the burrs.

8. An apparatus in accordance with claim 5 wherein:

each deburring element rests on a sloping surface of the retaining body which slopes radially outward from an inner portion of the circumference of the retaining body to an outer portion of the circumference of the retaining body.

9. An apparatus in accordance with claim 8 wherein:

the sloping surface is part of an expanding ring surrounding a lower portion of the circumference of the retaining body.

10. An apparatus in accordance with claim 5 wherein:

the deburring portion of each deburring element has a radius which varies around the circumference of the retaining body.

11. An apparatus in accordance with claim 5 wherein:

the retaining body has a cross-sectional shape which is a cylindrical section.

12. An apparatus in accordance with claim 5 further comprising:

a plurality of retaining bodies mounted on a mounting plate, each retaining body having at least one deburring element, each deburring element having a deburring portion extending radially outward from the deburring element for removing burrs, displacement of the retaining bodies in the second axial direction causing the deburring portion of each deburring element to move radially outward and the deburring elements being displaceable radially inward and radially outward during displacement of the plurality of retaining bodies in the first axial direction.

13. An apparatus in accordance with claim 5 further comprising:

elastically pretensioned spring bolts extending from a mounting plate to which is attached at least one retaining body, the elastically pretensioned spring bolts having an axis parallel to an axis of the retaining body.

* * * * *